US008413636B2

(12) United States Patent
Suzuki et al.

(10) Patent No.: US 8,413,636 B2
(45) Date of Patent: Apr. 9, 2013

(54) FUEL INJECTION APPARATUS FOR INTERNAL COMBUSTION ENGINE

(75) Inventors: Takashi Suzuki, Susono (JP); Takashi Koyama, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/229,218

(22) Filed: Sep. 9, 2011

(65) Prior Publication Data

US 2011/0315121 A1 Dec. 29, 2011

Related U.S. Application Data

(63) Continuation of application No. PCT/JP2009/055661, filed on Mar. 23, 2009.

(51) Int. Cl.

| | |
|---|---|
| ***F02D 17/04*** | (2006.01) |
| ***F02D 2250/31*** | (2006.01) |
| ***F01M 1/24*** | (2006.01) |
| ***F02M 63/0225*** | (2006.01) |

(52) U.S. Cl.
USPC ..... 123/458; 123/198 DB; 123/446; 123/457; 123/464; 123/496

(58) Field of Classification Search ..... 123/480, 123/481, 198 F, 198 DB, 445, 446, 447, 453, 123/454, 456, 457, 458, 459, 464, 493, 495, 123/496, 502, 506, 507, 510, 511, 512, 513, 123/514; 701/104, 112, 113
See application file for complete search history.

(56) References Cited

U.S. PATENT DOCUMENTS

| | | | | |
|---|---|---|---|---|
| 2001/0023683 | A1 * | 9/2001 | Nakamura et al. | 123/457 |
| 2001/0023684 | A1 * | 9/2001 | Demura et al. | 123/457 |
| 2010/0006064 | A1 | 1/2010 | Mizuno | |

FOREIGN PATENT DOCUMENTS

| | | | |
|---|---|---|---|
| EP | 1 319 821 | A2 | 6/2003 |
| JP | U-64-046469 | | 3/1989 |
| JP | A-04-292571 | | 10/1992 |
| JP | A-2001-123912 | | 5/2001 |
| JP | A-2003-176761 | | 6/2003 |
| JP | 2004-036459 | * | 2/2004 |
| JP | A-2004-036459 | | 2/2004 |
| JP | A-2004-162538 | | 6/2004 |
| JP | A-2007-051548 | | 3/2007 |
| JP | A-2008-095579 | | 4/2008 |

OTHER PUBLICATIONS

International Search Report issued in International Application No. PCT/JP2009/055661 dated Jun. 16 2009.

* cited by examiner

*Primary Examiner* — Stephen K Cronin
*Assistant Examiner* — Raza Najmuddin
(74) *Attorney, Agent, or Firm* — Oliff & Berridge, PLC

(57) ABSTRACT

The temperature of the fuel is raised without consuming the fuel in a fuel injection apparatus for an internal combustion engine. The fuel injection apparatus for the internal combustion engine comprises judging means which judges whether or not a fuel cut state, in which supply of fuel to the internal combustion engine is temporarily stopped during deceleration of a vehicle, is given; and discharge means which discharges the fuel by means of a motive power applied from a rotary shaft of the internal combustion engine; the fuel injection apparatus for the internal combustion engine further comprising increasing means which increases work of the discharge means when it is judged by the judging means that the fuel cut state is given as compared with when it is not judged by the judging means that the fuel cut state is given.

6 Claims, 13 Drawing Sheets

FUEL INJECTION APPARATUS FOR INTERNAL COMBUSTION ENGINE

CROSS REFERENCE TO RELATED APPLICATIONS

This is a continuation of Application, filed under 35 U.S.C. §111(a) of international Application PCT/JP2009/055661, filed on Mar. 23, 2009, the contents of which are herein wholly incorporated by reference.

TECHNICAL FIELD

The present invention relates to a fuel injection apparatus for an internal combustion engine.

BACKGROUND ART

When the temperature of the fuel is low during the cold starting of an internal combustion engine, then the injected fuel is hardly vaporized, and the fuel concentration is locally raised. On account of such a situation, it is feared that the combustion state may be deteriorated and any uncombusted fuel may be discharged.

In relation thereto, a technique is known, in which an internal combustion engine is started after heating the fuel by means of a heater provided for an accumulator or an injector (see, for example, Patent Document 1). However, it is feared that the mileage or fuel efficiency may be deteriorated, because the energy is consumed by the heater.

Further, a technique is known, in which the work of a fuel pump is increased to raise the temperature of the fuel by increasing the discharge amount of the fuel pump and releasing any excessive fuel (see, for example, Patent Document 2). However, it is feared that the mileage or fuel efficiency may be deteriorated by an amount of increase in the work of the fuel pump.

CITATION LIST

Patent Literature

Patent Document 1: JP2007-051548A;
Patent Document 2: JP2003-176761A;
Patent Document 3: JP64-46469Y;
Patent Document 4: JP2004-162538A.

SUMMARY OF THE INVENTION

Technical Problem

The present invention has been made taking the foregoing problem into consideration, an object of which is to provide a technique wherein the temperature of the fuel is raised without consuming the fuel in a fuel injection apparatus for an internal combustion engine.

Solution to Problem

In order to achieve the object as described above, the fuel injection apparatus for the internal combustion engine according to the present invention adopts the following means. That is, the fuel injection apparatus for the internal combustion engine according to the present invention resides in a fuel injection apparatus for an internal combustion engine, comprising:

judging means which judges whether or not a fuel cut state, in which supply of fuel to the internal combustion engine is temporarily stopped during deceleration of a vehicle, is given; and discharge means which discharges the fuel by means of a motive power applied from a rotary shaft of the internal combustion engine, the fuel injection apparatus for the internal combustion engine further comprising:

increasing means which increases work of the discharge means when it is judged by the judging means that the fuel cut state is given as compared with when it is not judged by the judging means that the fuel cut state is given.

When the work of the discharge means is increased, the loss is also increased in the discharge means. The loss is, for example, the friction loss or the loss caused by the increase in the load. The temperature of the fuel is raised in accordance with the increase in the loss. In this context, the discharge means discharges the fuel by acquiring the driving force from the internal combustion engine. The internal combustion engine is rotated even when the fuel cut state is given. Therefore, the fuel is discharged from the discharge means. In this situation, the fuel is not consumed. In other words, when the work of the discharge means is increased in the fuel cut state, it is possible to raise the temperature of the fuel without consuming the fuel. That is, it is possible to raise the temperature of the fuel by utilizing the energy which would be uselessly released in an ordinary situation, for example, on account of the brake during the deceleration of the internal combustion engine. In other words, it is possible to quickly raise the temperature of the fuel while suppressing the deterioration of the mileage or fuel efficiency. Accordingly, it is possible to suppress the emission of any uncombusted fuel.

In the present invention, the fuel injection apparatus may further comprise pressure changing means which changes a pressure of the fuel, wherein the increasing means increases the work of the discharge means by increasing the pressure of the fuel by means of the pressure changing means.

In other words, the higher the pressure of the fuel is on the downstream side from the discharge means, the more increased the work of the discharge means is. The pressure of the fuel may be increased in relation to the discharge means, or the pressure of the fuel may be increased downstream from the discharge means. The pressure of the fuel is increased in the fuel cut state, and hence the pressure of the fuel can be increased without causing any deterioration of the combustion and any generation of the combustion noise. Accordingly, it is possible to increase the work of the discharge means, and hence it is possible to raise the temperature of the fuel.

In the present invention, the fuel injection apparatus may further comprise discharge amount changing means which changes a discharge amount of the fuel from the discharge means, wherein the increasing means increases the work of the discharge means by increasing the discharge amount of the fuel by means of the discharge amount changing means.

In other words, the more increased the discharge amount of the fuel from the discharge means is, the more increased the work of the discharge means is. The discharge amount of the fuel from the discharge means may be increased, for example, by increasing the discharge amount per unit time. Accordingly, it is possible to increase the work of the discharge means, and hence it is possible to raise the temperature of the fuel. The increase in the pressure of the fuel and the increase in the discharge amount of the fuel may be performed simultaneously. In this case, it is possible to raise the temperature of the fuel more quickly.

In the present invention, the fuel injection apparatus may further comprise pressure changing means which changes a pressure of the fuel and discharge amount changing means which changes a discharge amount of the fuel from the discharge means, wherein the increasing means increases the work of the discharge means as a whole by increasing any one of the pressure and the discharge amount of the fuel and decreasing the other.

In other words, even when the work of the discharge means is decreased on account of the decrease in the other of the pressure and the discharge amount of the fuel, it is possible to increase the work of the discharge means as a whole on condition that the work is increased while exceeding the amount of the decrease, on account of the increase in one of the pressure and the discharge amount of the fuel. Accordingly, it is possible to increase the work of the discharge means under a broader condition.

In the present invention, the fuel injection apparatus may further comprise:

detecting means which detects a temperature of the fuel of the internal combustion engine; and heating means which heats the fuel by generating heat, wherein:

the work of the discharge means is increased by the increasing means if the temperature, which is detected by the detecting means, is not more than a threshold value and it is judged by the judging means that the fuel cut state is given; and the fuel is heated by the heating means if the temperature, which is detected by the detecting means, is not more than the threshold value and it is judged by the judging means that the fuel cut state is not given.

In other words, the increase in the work of the discharge means and the heating by the heating means are switched depending on the operation state of the internal combustion engine in order to raise the temperature of the fuel. In this context, when the fuel is heated by the heating means, the consumption of the fuel is caused. On the other hand, when the work of the discharge means is increased during any period other than the period of the fuel cut, the consumption amount of the fuel is increased. On the contrary, the work of the discharge means is increased, and the heating by the heating means is stopped in the fuel cut state when the temperature of the fuel is raised. Accordingly, it is possible to raise the temperature of the fuel without consuming the fuel in the fuel cut state. When the fuel cut state is not given, i.e., when the fuel is supplied, then it is possible to quickly raise the temperature of the fuel by heating the fuel by means of the heating means. In this situation, the work of the discharge means is not increased. In this way, it is possible to raise the temperature of the fuel while reducing the consumption amount of the fuel. The threshold value may be the upper limit value of the fuel temperature required to be raised. It is also allowable that the threshold value is the fuel temperature provided when the internal combustion engine is subjected to the cold starting.

In the present invention;

the increase in the work of the discharge means by the increasing means or the heating of the fuel by the heating means may be started if the temperature, which is detected by the detecting means, is lower than a predetermined lower limit value; and the increase in the work of the discharge means by the increasing means and the heating of the fuel by the heating means may be stopped if the temperature, which is detected by the detecting means, is higher than a predetermined upper limit value.

Accordingly, the temperature of the fuel can be the temperature between the predetermined lower limit value and the predetermined upper limit value. The predetermined lower limit value is the lower limit value of the target range of the fuel temperature. The predetermined upper limit value is the upper limit value of the target range of the fuel temperature. In other words, the control may be performed so that the fuel temperature is within the target range. If the heating of the fuel by the heating means and the increase in the work of the discharge means by the increasing means are stopped when the temperature, which is detected by the detecting means, is the predetermined upper limit value, then it is possible to suppress the fuel temperature from being excessively raised. On the other hand, if the heating of the fuel by the heating means or the increase in the work of the discharge means by the increasing means is started when the temperature, which is detected by the detecting means, is lower than the predetermined lower limit value, then it is possible to suppress the emission of any uncombusted fuel. In this context, the fuel temperature is not raised until the fuel temperature is lowered to the lower limit value after the fuel temperature is higher than the upper limit value and the increase in the fuel temperature is stopped. Further, the fuel temperature is raised until the fuel temperature is raised to the upper limit value after the fuel temperature is lower than the lower limit value and the increase in the fuel temperature is started.

Advantageous Effects of Invention

According to the fuel injection apparatus for the internal combustion engine concerning the present invention, it is possible to raise the temperature of the fuel without consuming the fuel.

DESCRIPTION OF EMBODIMENTS

Specified embodiments of the fuel injection apparatus for the internal combustion engine according to the present invention will be explained below on the basis of the drawings. It is noted that the following embodiments can be combined with each other as far as possible.

First Embodiment

Figure 1:
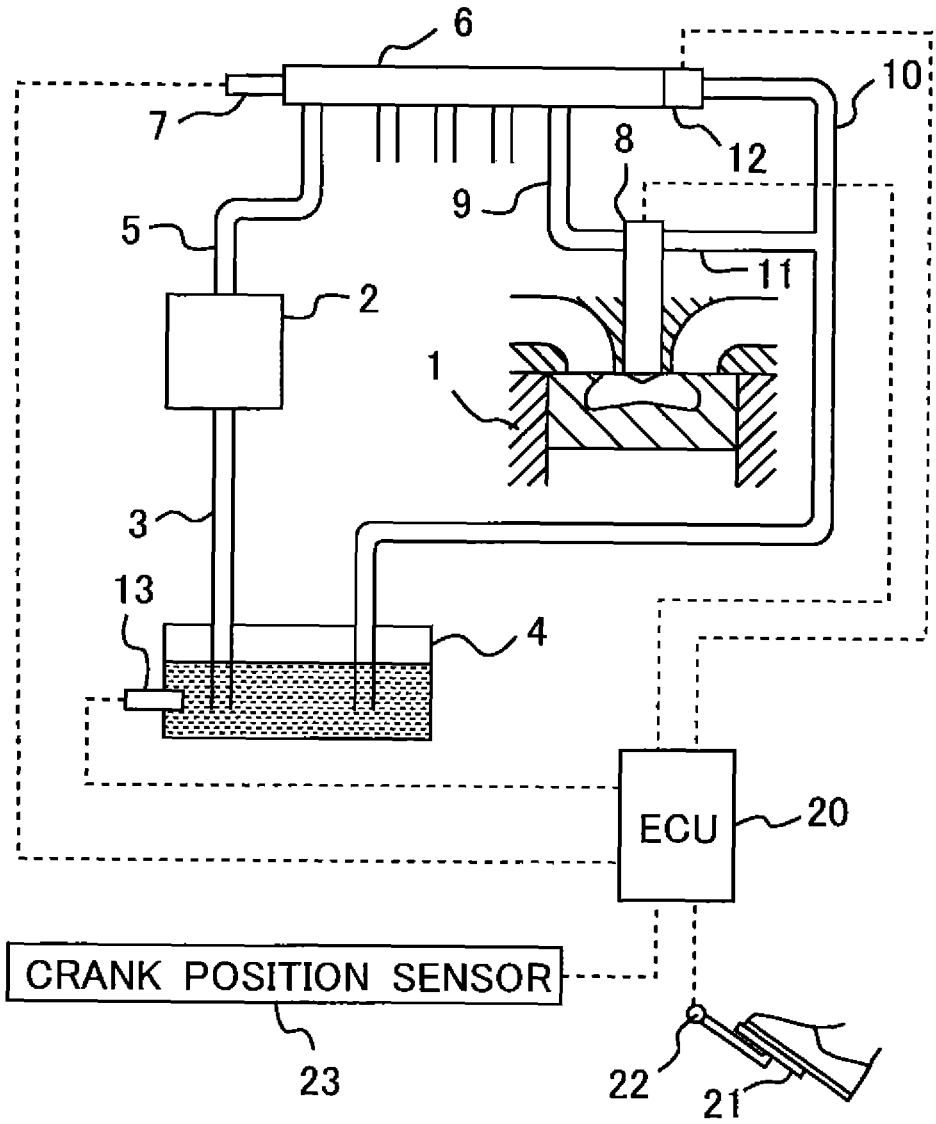
FIG. 1 shows a schematic arrangement illustrating a fuel injection apparatus for an internal combustion engine according to a first embodiment.

FIG. 1 shows a schematic arrangement illustrating a fuel injection apparatus for an internal combustion engine according to this embodiment. The internal combustion engine 1 shown in FIG. 1 is carried on a vehicle. The internal combustion engine 1 is a four-cylinder diesel engine. In this embodiment, parts of constitutive elements are omitted from the illustration in order to depict the system simply.

The internal combustion engine 1 is provided with a fuel pump 2 to which the motive power is applied from a crank shaft so that the fuel is discharged. The fuel pump 2 is a pump which is operated by using, as the driving source, the rotary torque of the crank shaft of the internal combustion engine 1. One end of a fuel suction passage 3 is connected to the inlet side of the fuel pump 2. The other end of the fuel suction passage 3 is open in the fuel which is stored in a fuel tank 4. In this embodiment, the fuel pump 2 corresponds to the discharge means according to the present invention.

One end of a fuel supply passage 5 is connected to the outlet side of the fuel pump 2. The other end side of the fuel supply passage 5 is connected to an accumulator (common rail) 6 which accumulates the fuel until arrival at a predetermined pressure. A pressure sensor 7, which measures the pressure of the fuel contained in the common rail 6, is attached to the common rail 6. An injection valve 8, which injects the fuel directly into the cylinder, is provided for each of the cylinders of the internal combustion engine 1. The common rail 6 is connected to the injection valves 8 via branch pipes 9 respectively.

A return passage 10, which returns a part of the fuel contained in the common rail 6 to the fuel tank 4, has one end which is connected to the common rail 6. The other end of the return passage 10 is connected to the fuel tank 4. A discharge passage 11, which is provided to return a part of the fuel contained in the injection valve 8, has one end which is connected to the injection valve 8. The other end of the discharge passage 11 is connected to the return passage 10.

A relief valve 12 is provided at the connecting portion between the common rail 6 and the return passage 10. The relief valve 12 is fully closed when the pressure of the fuel is less than a preset pressure, and the relief valve 12 shuts off the flow of the fuel directed from the common rail 6 to the return passage 10. On the other hand, when the pressure of the fuel is not less than the preset pressure, then the relief valve 12 is opened, and the fuel is allowed to flow from the common rail 6 to the return passage 10. The fuel pump 2 discharges the fuel in an amount sufficient for the pressure in the fuel supply passage 5 to be not less than the preset pressure.

In the system constructed as described above, the fuel, which is stored in the fuel tank 4, is sucked by the fuel pump 2 via the fuel suction passage 3. The fuel, which is intaken into the inside, is discharged by the fuel pump 2 to the fuel supply passage 5. The fuel, which is allowed to flow through the fuel supply passage 5, is stored in the common rail 6. The pressure of the fuel contained in the common rail 6 is raised by the fuel pump 2. The high pressure fuel is supplied to the injection valve 8 via the branch pipe 9.

The relief valve 12 is operated every time when the pressure in the common rail 6 arrives at the preset pressure. Therefore, the pressure of the fuel contained in the common rail 6 is regulated to be in the vicinity of the preset pressure. When the relief valve 12 is opened, then the fuel is allowed to flow from the inside of the common rail 6 to the return passage 10, and the fuel is returned to the fuel tank 4.

Further, when the fuel is allowed to flow into the injection valve 8 in accordance with the opening of the injection valve 8, then a part of the fuel is injected from the injection valve 8, and the remaining fuel is allowed to flow to the discharge passage 11. The fuel is allowed to flow into the return passage 10 from the discharge passage 11, and the fuel is returned to the fuel tank 4.

In relation to the relief valve 12 according to this embodiment, it is possible to change the preset pressure. In other words, it is possible to change the pressure at which the relief valve 12 is opened. Therefore, it is possible to change the pressure of the fuel contained in the common rail 6. The preset pressure may be changed in a stepwise manner, or the preset pressure may be changed in a stepless manner. In this embodiment, the electromotive relief valve 12 is adopted, and the relief valve 12 is opened when the pressure in the common rail 6, which is measured by the pressure sensor 7, is not less than the preset pressure. For example, when the relief valve 12 is a check valve which utilizes the urging force of a spring, then the urging force of the spring, which is to be provided when the valve is closed, can be regulated by changing the length of the spring, and it is possible to change the pressure (i.e., the preset pressure) required to open the relief valve 12.

A temperature sensor 13, which measures the temperature of the stored fuel, is attached to the fuel tank 4. The temperature sensor 13 may measure the temperature of the fuel at any other portion (for example, the fuel supply passage 5, the common rail 6, or the return passage 10). In this embodiment, the temperature sensor 13 corresponds to the detecting means according to the present invention.

ECU 20, which is an electronic control unit to control the internal combustion engine 1, is provided in combination with the internal combustion engine 1 constructed as described above. ECU 20 is the unit which controls the operation state of the internal combustion engine 1 depending on the operation condition of the internal combustion engine 1 and the request of a driver.

Further, those connected to ECU 20 via electric wiring lines in addition to the sensor as described above are an accelerator opening degree sensor 22 which outputs the electric signal corresponding to the pedaling amount of the accelerator pedal 21 pedaled by the driver and which is capable of detecting the engine load, and a crank position sensor 23 which detects the number of revolutions of the engine. Thus, the output signals of various sensors are inputted into ECU 20.

On the other hand, the injection valves 8 and the relief valve 12 are connected to ECU 20 via electric wiring lines. The opening/closing timings of the injection valves 8 and the relief valve 12 are controlled by ECU 20.

In this embodiment, if the temperature of the fuel is not more than the threshold value, the work of the fuel pump 2 is increased during the fuel cut for the internal combustion engine 1. In order to increase the work of the fuel pump 2, the fuel pressure is increased. It is also allowable that the fuel pressure is increased during the fuel cut for the internal combustion engine 1 irrelevant to the fuel temperature. The fuel temperature is obtained by means of the temperature sensor 13. The threshold value is the upper limit value of the fuel temperature required to be raised. The phrase "if the temperature of the fuel is not more than the threshold value" refers to the situation in which it is necessary to raise the fuel temperature, which may reside in, for example, the cold state or situation of the internal combustion engine 1. The temperature of the fuel may be estimated, for example, from the temperature of the cooling water or the temperature of the outside air.

It is judged by ECU 20 whether or not the fuel cut state is given. The fuel cut refers to such a situation that the fuel injection from the injection valve 8 is temporarily stopped during the operation of the internal combustion engine 1. The fuel cut is performed, for example, when the accelerator pedal 21 is not pedaled and when the number of revolutions of the engine is not less than a prevention value. In such an operation state, ECU 20 stops the fuel injection from the injection valve 8 and ECU 20 judges that the fuel cut state is given. It is also allowable that the fuel cut is performed during the deceleration of the vehicle or the internal combustion engine 1. In this embodiment, ECU 20, which judges whether or not the fuel cut state is given, corresponds to the judging means according to the present invention.

The fuel pressure is increased by raising the preset pressure of the relief valve 12. In other words, when the preset pressure of the relief valve 12 is raised, the fuel pressure in the fuel supply passage 5 is more raised.

When the fuel pressure is raised as described above, the work of the fuel pump 2 is increased. Accordingly, it is possible to quickly raise the fuel temperature. Further, the work of the fuel pump 2 is increased during the fuel cut. Therefore, it is possible to raise the fuel temperature without consuming the fuel.

Figure 2:
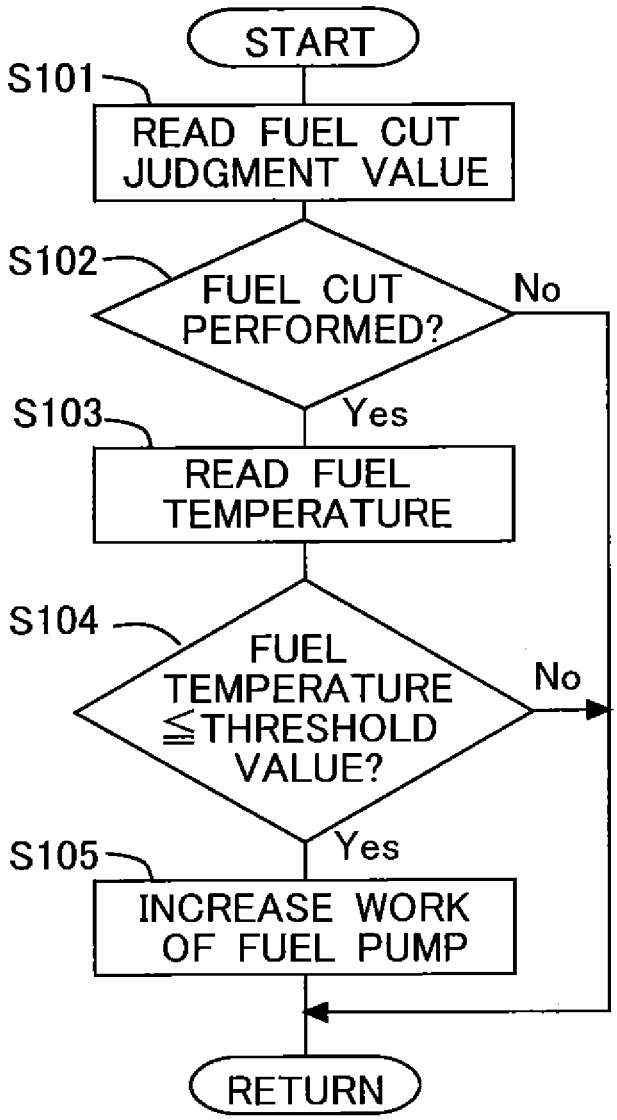
FIG. 2 shows a flow chart illustrating a flow to increase the work of a fuel pump according to the embodiment.

FIG. 2 shows a flow chart illustrating a flow to increase the work of the fuel pump 2 according to this embodiment. This routine is repeatedly executed by ECU 20 at every predetermined period of time.

In Step S101, the value, which is required to judge whether or not the fuel cut is performed, is read as the fuel cut judgment value. For example, the accelerator opening degree and the number of revolutions of the engine are read. It is also allowable to detect the velocity of the vehicle.

In Step S102, it is judged whether or not the fuel cut is performed, on the basis of the fuel cut judgment value. In this step, it is judged whether or not an operation state is given, in which the fuel temperature can be raised without deteriorating the mileage or fuel efficiency even when the fuel pressure is raised. In this procedure, it is also allowable to judge whether or not the deceleration of the vehicle is performed. It is also allowable to judge whether or not the number of revolutions of the engine is not less than a predetermined value, while the accelerator pedal 21 is not pedaled. If the affirmative judgment is made in Step S102, the routine proceeds to Step S103. If the negative judgment is made, this routine is completed, because the mileage or fuel efficiency may be deteriorated.

In Step S103, the fuel temperature is read. In other words, the temperature, which is measured by the temperature sensor 13, is read.

In Step S104, it is judged whether or not the fuel temperature is not more than the threshold value. In other words, it is judged whether or not the fuel temperature is required to be raised. If the affirmative judgment is made in Step S104, the routine proceeds to Step S105. If the negative judgment is made, this routine is completed, because it is unnecessary to raise the fuel temperature.

In Step S105, the work of the fuel pump 2 is increased. That is, the fuel pressure is increased in this embodiment. In other words, the pressure, at which the relief valve 12 is opened, is raised. When the pressure, at which the relief valve 12 is opened, can be continuously changed, the pressure may be raised by a predetermined pressure as compared with the present point in time. Alternatively, the pressure may be raised to a preset pressure. When the pressure, at which the relief valve 12 is opened, can be changed in a stepwise manner, the pressure may be changed to a level at which the pressure is high as compared with the present point in time. Alternatively, it is also allowable to provide a preset level of the fuel pressure. In this way, the work of the fuel pump 2 is increased, and the fuel temperature is raised. In this embodiment, ECU 20, which processes Step S105, corresponds to the increasing means according to the present invention. In this embodiment, the relief valve 12 corresponds to the pressure changing means according to the present invention.

As explained above, according to this embodiment, the fuel pressure is increased when the fuel temperature is low. Therefore, it is possible to quickly raise the fuel temperature. Further, the fuel temperature is raised during the fuel cut. Therefore, it is possible to suppress the deterioration of the mileage or fuel efficiency. The relief valve 12 may be provided with a mechanism which mechanically increases the fuel pressure during the deceleration.

Second Embodiment

Figure 3:
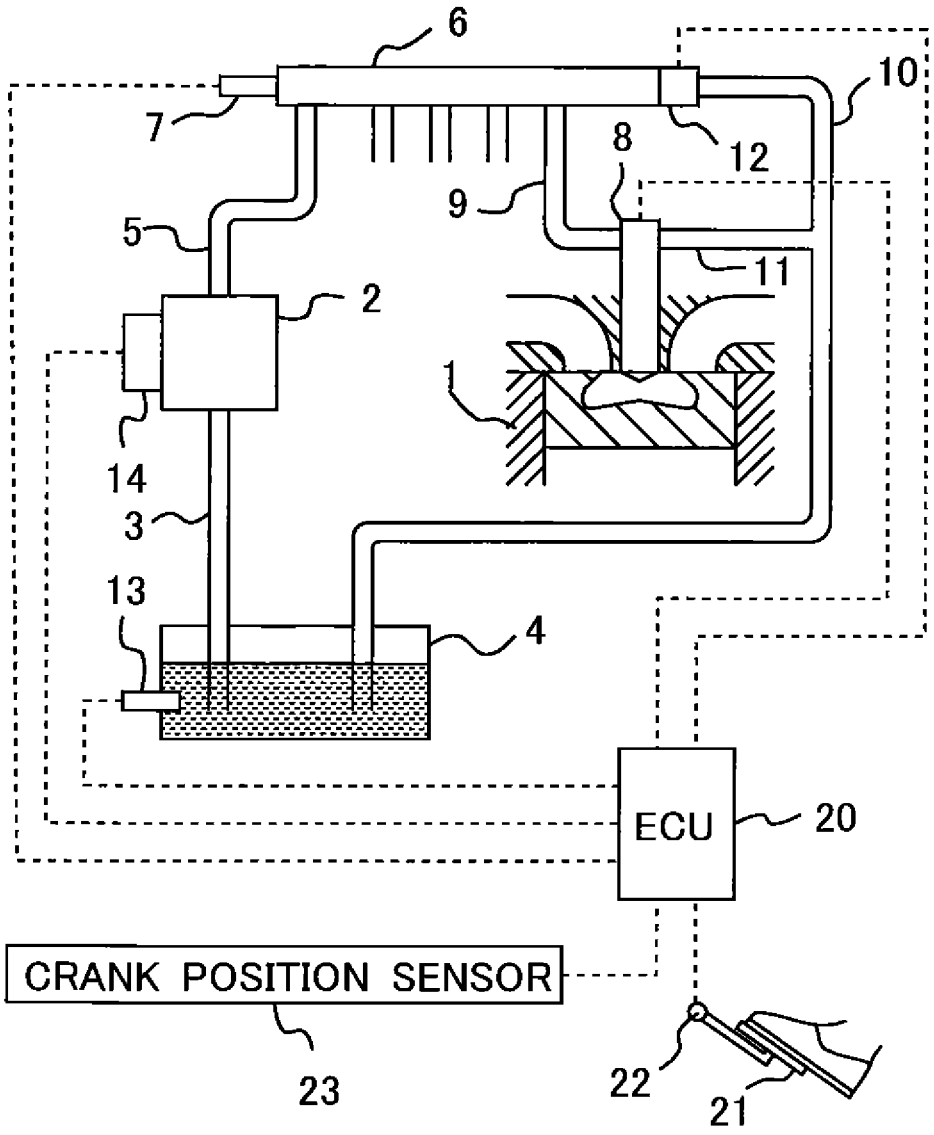
FIG. 3 shows a schematic arrangement illustrating a fuel injection apparatus for an internal combustion engine according to a second embodiment.

In this embodiment, the discharge amount of the fuel pump 2 is increased as a technique for increasing the work of the fuel pump 2. FIG. 3 shows a schematic arrangement illustrating a fuel injection apparatus for an internal combustion engine according to this embodiment. In this embodiment, the volume of the fuel pump 2 is changed by means of an actuator 14, and thus the discharge amount of the fuel pump 2 is changed. The actuator 14 is connected to ECU 20 via an electric wiring line. The discharge amount of the fuel pump 2 is controlled by ECU 20. The other components of the apparatus are the same as those of the first embodiment, and hence any explanation thereof will be omitted. In this embodiment, the actuator 14 corresponds to the discharge amount changing means according to the present invention. Further, in this embodiment, it is unnecessary to change the preset pressure for the relief valve 12.

In this embodiment, the discharge amount of the fuel pump 2 is increased by increasing the fuel amount to be discharged by the fuel pump 2 once. The discharge amount of the fuel pump 2 may be increased by changing the ratio between the number of revolutions of the crank shaft and the number of times of the discharge of the fuel pump 2. Alternatively, the discharge amount can be also increased by driving the fuel pump 2 by means of an electric motor and changing the number of revolutions of the electric motor. Further, a plurality of fuel pumps 2 may be provided, and the discharge amount may be increased by changing the number and the type of the fuel pump or fuel pumps 2 to be operated.

In this embodiment, if the temperature of the fuel is not more than the threshold value, the fuel discharge amount is increased during the fuel cut for the internal combustion engine 1. In other words, the fuel discharge amount is increased in this embodiment in place of the increase in the fuel pressure in the first embodiment.

In this situation, the work of the fuel pump 2 is increased by increasing the fuel discharge amount. Accordingly, it is possible to quickly raise the fuel temperature. The work of the fuel pump 2 is increased during the fuel cut, and hence it is possible to raise the fuel temperature without consuming the fuel.

In this embodiment, the fuel discharge amount is increased in Step S105 of the flow shown in FIG. 2. When the fuel discharge amount can be continuously changed, the fuel discharge amount may be increased by a predetermined amount as compared with the present point in time. Alternatively, the fuel discharge amount may be raised until arrival at a preset discharge amount. When the fuel discharge amount can be changed in a stepwise manner, the fuel discharge amount may be changed to a level at which the discharge amount is increased as compared with the present point in time. Alternatively, it is also allowable to provide a preset level of the fuel discharge amount. In this way, the work of the fuel pump 2 is increased, and the fuel temperature is raised. In this embodiment, ECU 20, which processes Step S105, corresponds to the increasing means according to the present invention.

As explained above, according to this embodiment, the fuel discharge amount is increased when the fuel temperature is low. Therefore, it is possible to quickly raise the fuel temperature. Further, the fuel temperature is raised during the fuel cut. Therefore, it is possible to suppress the deterioration of the mileage or fuel efficiency.

An extremely small pulse, which is to such an extent that the fuel is not injected, may be applied to the injection valve 8 when the work of the fuel pump 2 is increased. For example, the pulse width may be maximized within a range in which the fuel cannot be injected. In this way, a larger amount of the fuel can be allowed to flow to the discharge passage 11. Therefore, it is possible to further increase the discharge amount of the fuel pump 2. Accordingly, it is possible to quickly raise the fuel temperature. Further, it is possible to more quickly raise the temperatures of the injection valve 8 and the discharge passage 11.

Third Embodiment

In this embodiment, an explanation will be made about a control mode in which the increase in the fuel pressure concerning the first embodiment and the increase in the fuel discharge amount concerning the second embodiment are simultaneously performed when the work of the fuel pump 2 is increased.

Figure 4:
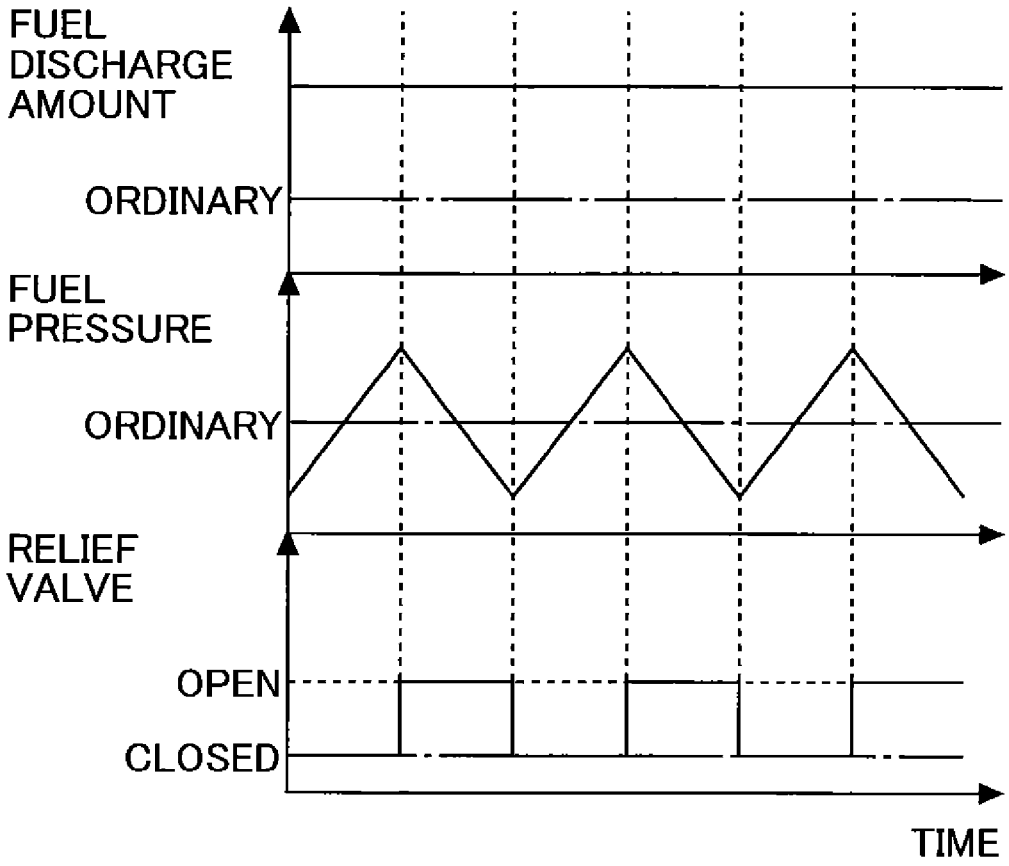
FIG. 4 shows a first time chart illustrating the transition or change of the state of a relief valve, the fuel pressure, and the fuel discharge amount.

FIG. 4 shows a first time chart illustrating the transition or change of the state of the relief valve 12, the fuel pressure, and the fuel discharge amount. The state of the relief valve 12 indicates whether the relief valve 12 is fully open or fully closed. The fuel pressure is the pressure in the common rail 6 as measured by the pressure sensor 7. The fuel discharge amount is the discharge amount of the fuel pump 2 as controlled by ECU 20. The fuel discharge amount may be measured by a sensor. The respective values, which are provided during the fuel cut, are depicted by solid lines, and the respective values, which are provided during the fuel injection (also referred to as "ordinary situation"), are depicted by alternate long and short dash lines. The situation, in which the fuel is injected, is depicted as "ordinary".

In the case of the control mode shown in FIG. 4, the fuel discharge amount, which is provided during the fuel cut, is constant in such a state that the fuel discharge amount during the fuel cut is larger than that provided in the ordinary situation. That is, the fuel discharge amount is increased by the actuator 14, and the fuel discharge amount is constant. In this case, the fuel discharge amount, which is provided in the ordinary situation, is the fuel discharge amount which is provided when the fuel injection is performed. Also in this case, the fuel discharge amount is constant.

The relief valve 12 is controlled so that the fuel pressure, which is provided during the fuel cut, is fluctuated about the center of the value provided in the ordinary situation. In other words, when the fuel is discharged from the fuel pump 2, the fuel pressure is raised in accordance therewith. However, the relief valve 12 is opened when the fuel pressure is higher than that provided in the ordinary situation by a predetermined value. Accordingly, the fuel pressure is lowered. After that, the relief valve 12 is closed when the fuel pressure is lower than that provided in the ordinary situation by a predetermined value. When the operation as described above is repeated, the fuel pressure, which is provided during the fuel cut, is fluctuated about the center of the value provided in the ordinary situation. Optimum values are determined beforehand, for example, by means of an experiment for the pressure at which the relief valve 12 is opened and the pressure at which the relief valve 12 is closed. The predetermined value may be 0.

In the mode shown in FIG. 4, no change arises between the fuel cut state and the ordinary situation when the fuel pressures are averaged. However, the fuel discharge amount, which is provided during the fuel cut, is larger than that provided in the ordinary situation. Therefore, the work of the fuel pump 2 is increased as a whole. The average value of the fuel pressures may be lower than that provided in the ordinary situation, on condition that the work of the fuel pump 2 during the fuel cut is increased as a whole as compared with the ordinary situation.

Figure 5:
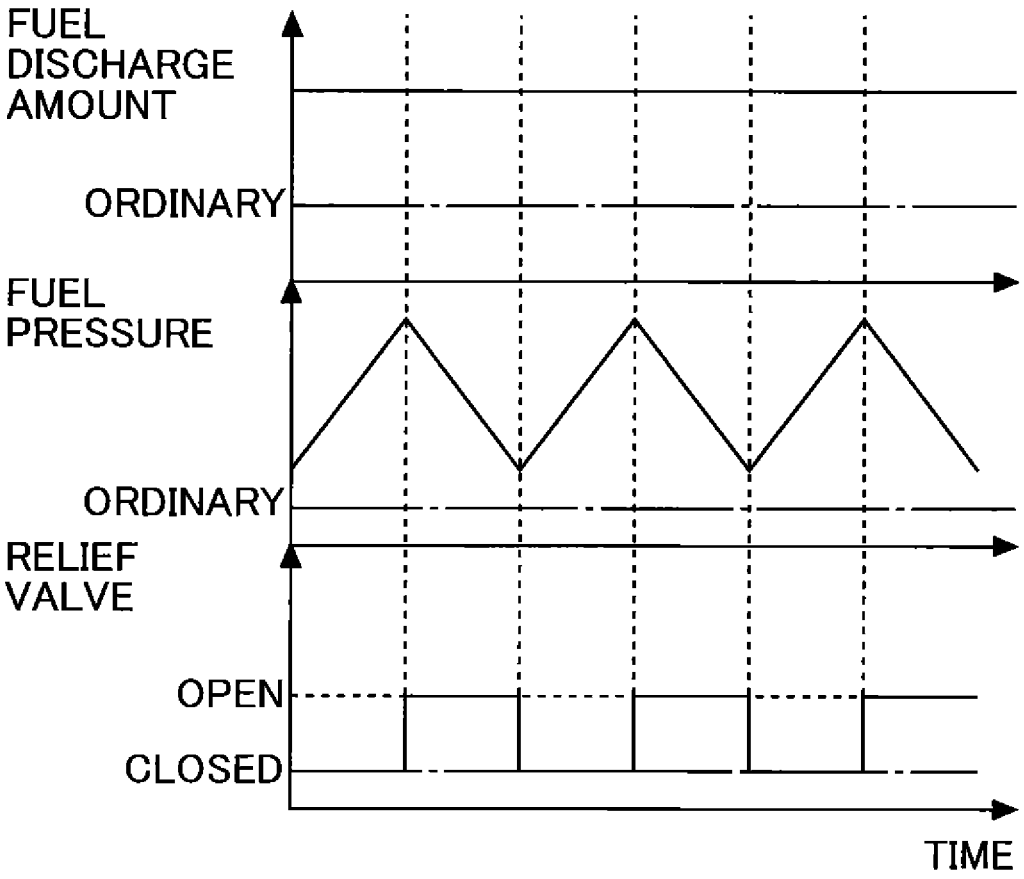
FIG. 5 shows a second time chart illustrating the transition or change of the state of the relief valve, the fuel pressure, and the fuel discharge amount.

Next, FIG. 5 shows a second time chart illustrating the transition or change of the state of the relief valve 12, the fuel pressure, and the fuel discharge amount.

Also in the case of the control mode shown in FIG. 5, the fuel discharge amount, which is provided during the fuel cut, is constant in such a state that the fuel discharge amount during the fuel cut is larger than that provided in the ordinary situation. On the other hand, the relief valve 12 is controlled so that the fuel pressure, which is provided during the fuel cut, is fluctuated while always providing values higher than that provided in the ordinary situation. In other words, unlike the case shown in FIG. 4, the fuel pressure is higher than that provided in the ordinary situation even when the relief valve 12 is closed during the fuel cut. The fuel pressure, which is provided during the fuel cut, is fluctuated about the center of the value higher than that provided in the ordinary situation. Optimum values are determined beforehand, for example, by means of an experiment for the pressure at which the relief valve 12 is opened and the pressure at which the relief valve 12 is closed. The relief valve 12 may be repeatedly opened and closed at every predetermined period of time.

In the mode shown in FIG. 5, the average value of the fuel pressures provided during the fuel cut is higher than that provided in the ordinary situation. In other words, the fuel pressure and the fuel discharge amount, which are provided during the fuel cut, are increased as compared with those provided in the ordinary situation. Therefore, the work of the fuel pump 2 is increased as a whole. The degree of increase in the work of the fuel pump 2 is larger than that obtained in the mode shown in FIG. 4.

Figure 6:
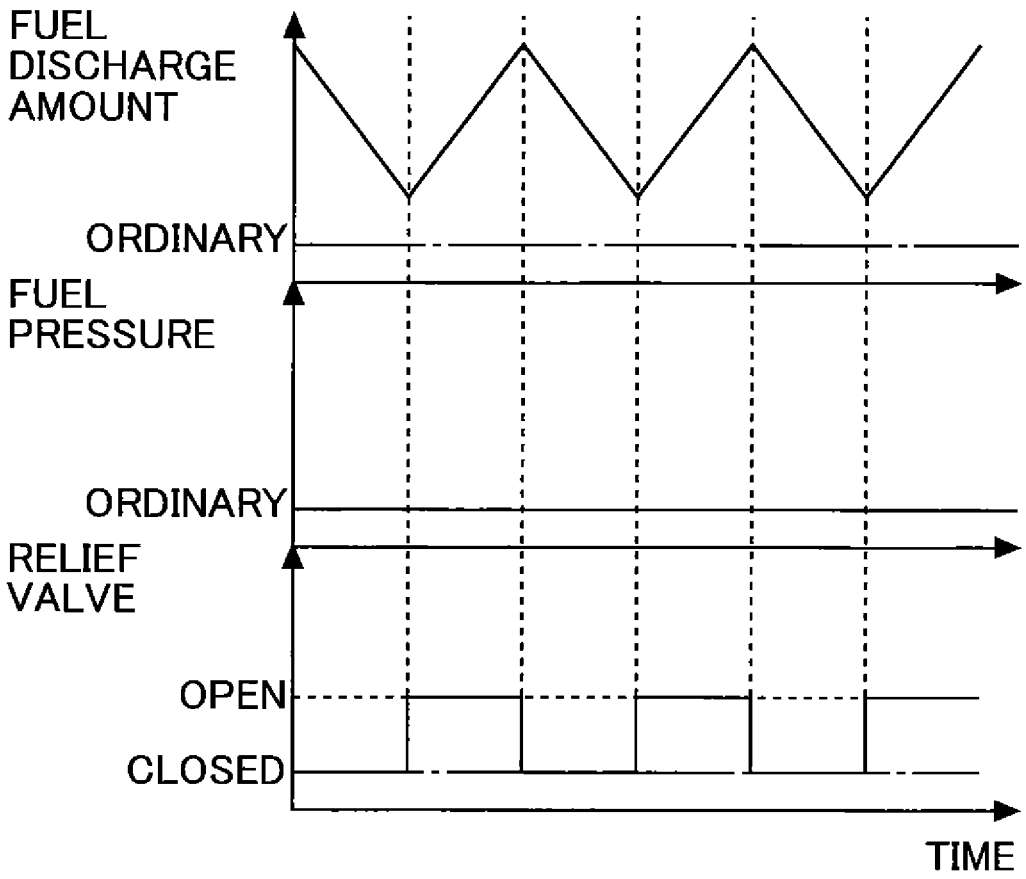
FIG. 6 shows a third time chart illustrating the transition or change of the state of the relief valve, the fuel pressure, and the fuel discharge amount.

Next, FIG. 6 shows a third time chart illustrating the transition or change of the state of the relief valve 12, the fuel pressure, and the fuel discharge amount.

In the case of the control mode shown in FIG. 6, the fuel discharge amount, which is provided during the fuel cut, is fluctuated while always providing the values larger than that provided in the ordinary situation. Further, the relief valve 12 is controlled so that the fuel pressure, which is provided during the fuel cut, is equal to that provided in the ordinary situation. In other words, when the fuel discharge amount is progressively increased, the fuel pressure may be increased as well. In relation thereto, when the fuel discharge amount is increased, the increase in the fuel pressure is suppressed by opening the relief valve 12. The fuel discharge amount may be determined so that the fuel pressure is constant.

On the other hand, the fuel discharge amount can be fluctuated by regulating the actuator 14. The fuel discharge amount, which is provided during the fuel cut, is fluctuated about the center of the value larger than that provided in the ordinary situation so that the minimum value is higher than the value provided in the ordinary situation. Optimum values are determined beforehand, for example, by means of an experiment for the fuel discharge amount which serves as the threshold value to start the increase in the fuel discharge amount and the fuel discharge amount which serves as the threshold value to start the decrease in the fuel discharge amount. The fuel discharge amount may be repeatedly increased and decreased every predetermined period of time.

In the mode shown in FIG. 6, the fuel discharge amount, which is provided during the fuel cut, is larger than that provided in the ordinary situation. In other words, the fuel discharge amount is increased, although the fuel pressure, which is provided during the fuel cut, is unchanged as compared with the ordinary situation. Therefore, the work of the fuel pump 2 is increased as a whole. The minimum value of the fuel discharge amount may be smaller than that provided in the ordinary situation, provided that the work of the fuel pump 2 is increased as a whole during the fuel cut.

Figure 7:
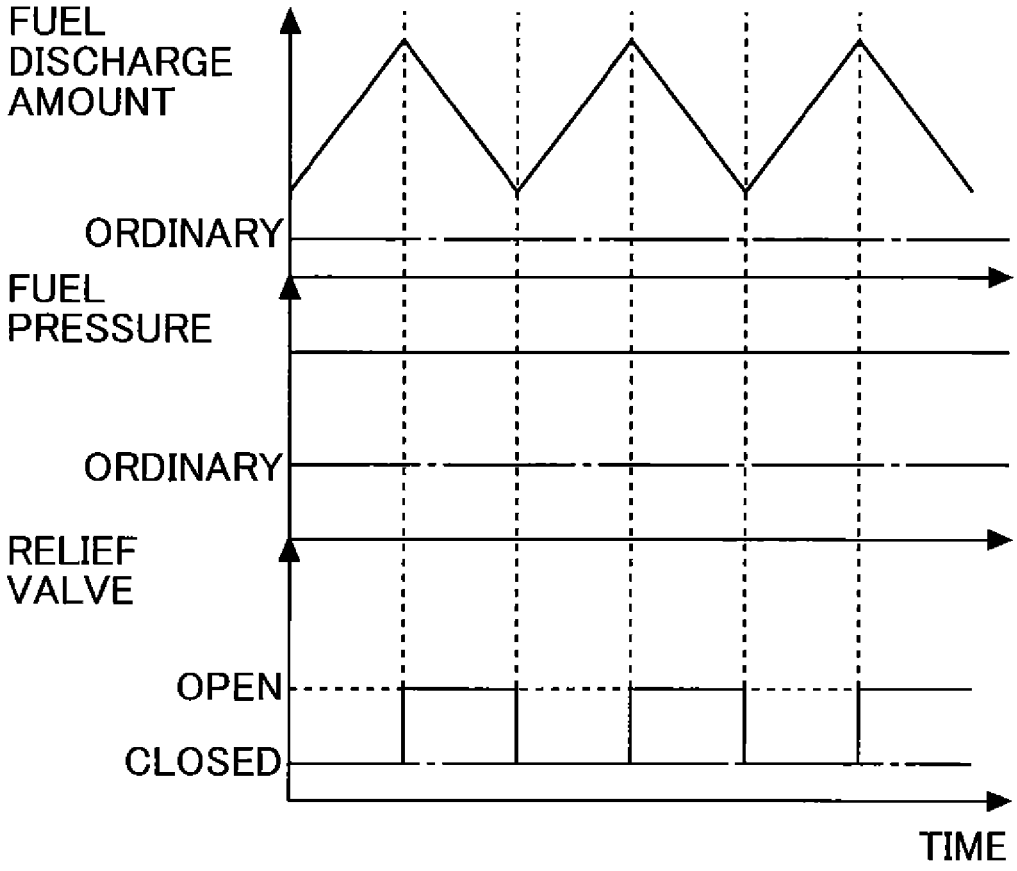
FIG. 7 shows a fourth time chart illustrating the transition or change of the state of the relief valve, the fuel pressure, and the fuel discharge amount.

Next, FIG. 7 shows a fourth time chart illustrating the transition or change of the state of the relief valve 12, the fuel pressure, and the fuel discharge amount.

Also in the case of the control mode shown in FIG. 7, the fuel discharge amount is controlled so that the fuel discharge amount, which is provided during the fuel cut, is fluctuated while always providing the value which is larger than that provided in the ordinary situation. However, unlike the case shown in FIG. 6, the relief valve 12 is controlled so that the fuel pressure, which is provided during the fuel cut, is constant while providing the value higher than that provided in the ordinary situation.

In the mode shown in FIG. 7, the fuel discharge amount and the fuel pressure, which are provided during the fuel cut, are higher than those provided in the ordinary situation. In other words, the work of the fuel pump 2 is increased as a whole during the fuel cut as compared with the ordinary situation. The degree of increase in the work of the fuel pump 2 is larger than that provided in the mode shown in FIG. 6.

The work of the fuel pump 2 is increased in accordance with the modes as described above, and thus it is possible to raise the temperature of the fuel. Even when any one of the fuel discharge amount and the fuel pressure during the fuel cut has the value smaller than that provided in the ordinary situation, it is appropriate that the work of the fuel pump 2 is increased as a whole during the fuel cut as compared with the ordinary situation.

Fourth Embodiment

Figure 8:
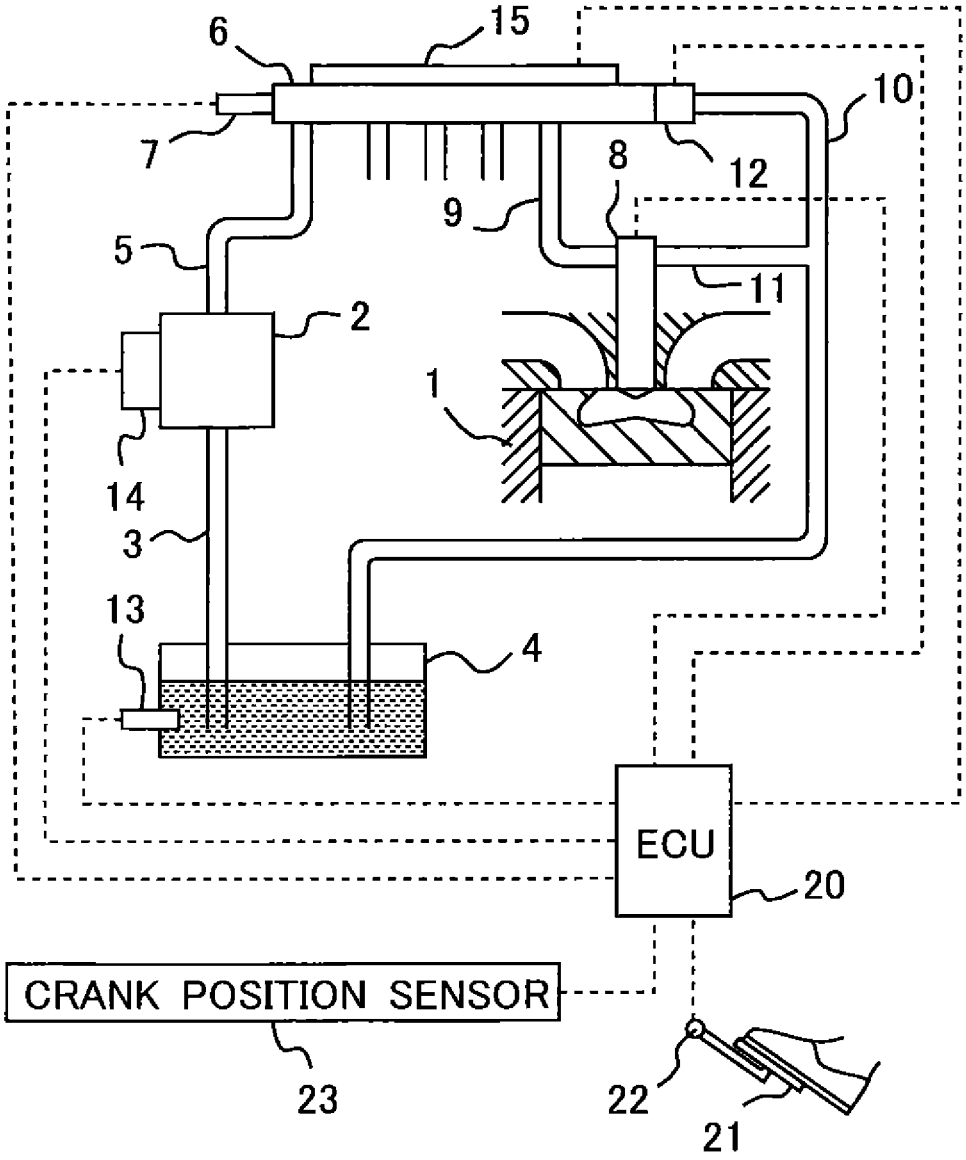
FIG. 8 shows a schematic arrangement illustrating a fuel injection apparatus for an internal combustion engine according to a fourth embodiment.

FIG. 8 shows a schematic arrangement illustrating a fuel injection apparatus for an internal combustion engine according to this embodiment. In this embodiment, a heater 15 is attached to the common rail 6. The heater 15 generates the heat in accordance with the supply of the electric power to raise the temperature of the fuel contained in the common rail 6. The heater 15 is controlled by ECU 20. The other components of the apparatus are the same as those shown in FIG. 3, and hence any explanation thereof will be omitted. In this embodiment, the heater 15 corresponds to the heating means according to the present invention. The heater 15 may heat the fuel by combusting the fuel. Further, the fuel may be heated at any portion other than the common rail 6 (for example, the fuel tank 4, the fuel supply passage 5, or the return passage 10).

Figure 9:
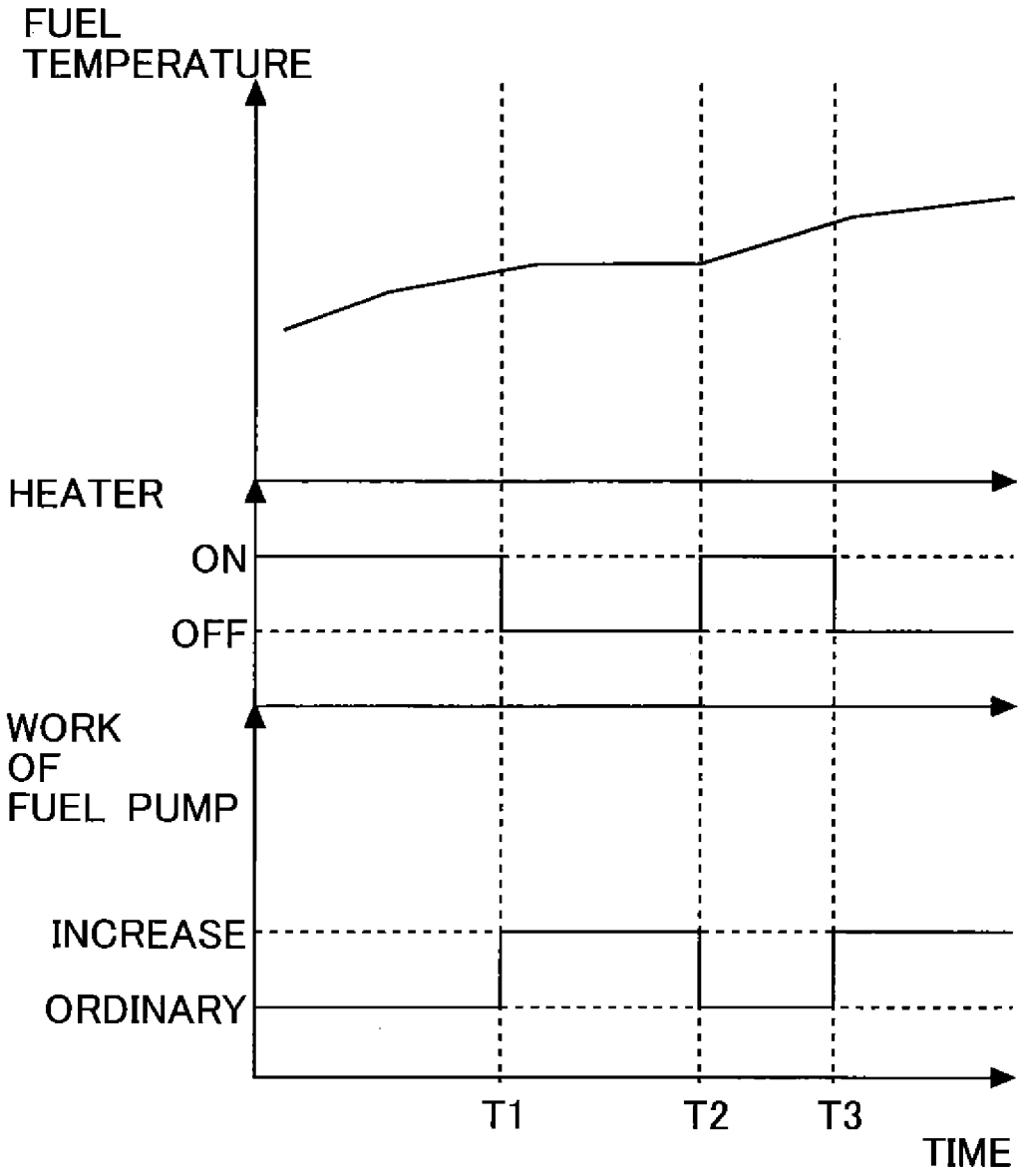
FIG. 9 shows a time chart illustrating the transition or change of the work of a fuel pump, the state of a heater, and the fuel temperature according to the fourth embodiment.

FIG. 9 shows a time chart illustrating the transition or change of the work of the fuel pump, the state of the heater 15, and the fuel temperature according to this embodiment. In relation to the work of the fuel pump, the "ordinary" refers to the value provided when the fuel is injected, and the "increase" refers to the value provided when the fuel cut is performed. In relation to the state of the heater 15, ON indicates the state provided when the electric power is supplied to the heater 15, and OFF indicates the state provided when the electric power is not supplied. The fuel cut is started at the time indicated by T1. The fuel cut is completed at the time indicated by T2. In other words, the fuel injection is started. The fuel cut is started again at the time indicated by T3.

In other words, the heater 15 is turned OFF at the fuel cut start times T1, T3, and the increase in the work of the fuel pump 2 is started. This state is maintained from T1 to T2 as the period of time in which the fuel cut is performed, and after T3. The heater 15 is turned ON at T2 which is the time to complete the fuel cut and start the fuel injection, and the work of the fuel pump 2 is returned to have the value provided in the ordinary situation. This state is maintained from T2 to T3 as the period of time in which the fuel injection is performed.

For example, when it is feared that the fuel may be frozen, if the electric power is always applied to the heater 15 to warm the fuel, then it is feared that the mileage or fuel efficiency may be deteriorated. On the contrary, in this embodiment, the application of the electric power to the heater 15 is stopped during the fuel cut, and the work of the fuel pump 2 is increased in place thereof. In other words, the fuel is heated by the heater 15 in the ordinary situation, while the temperature of the fuel is raised by increasing the work of the fuel pump 2 during the fuel cut.

Figure 10:
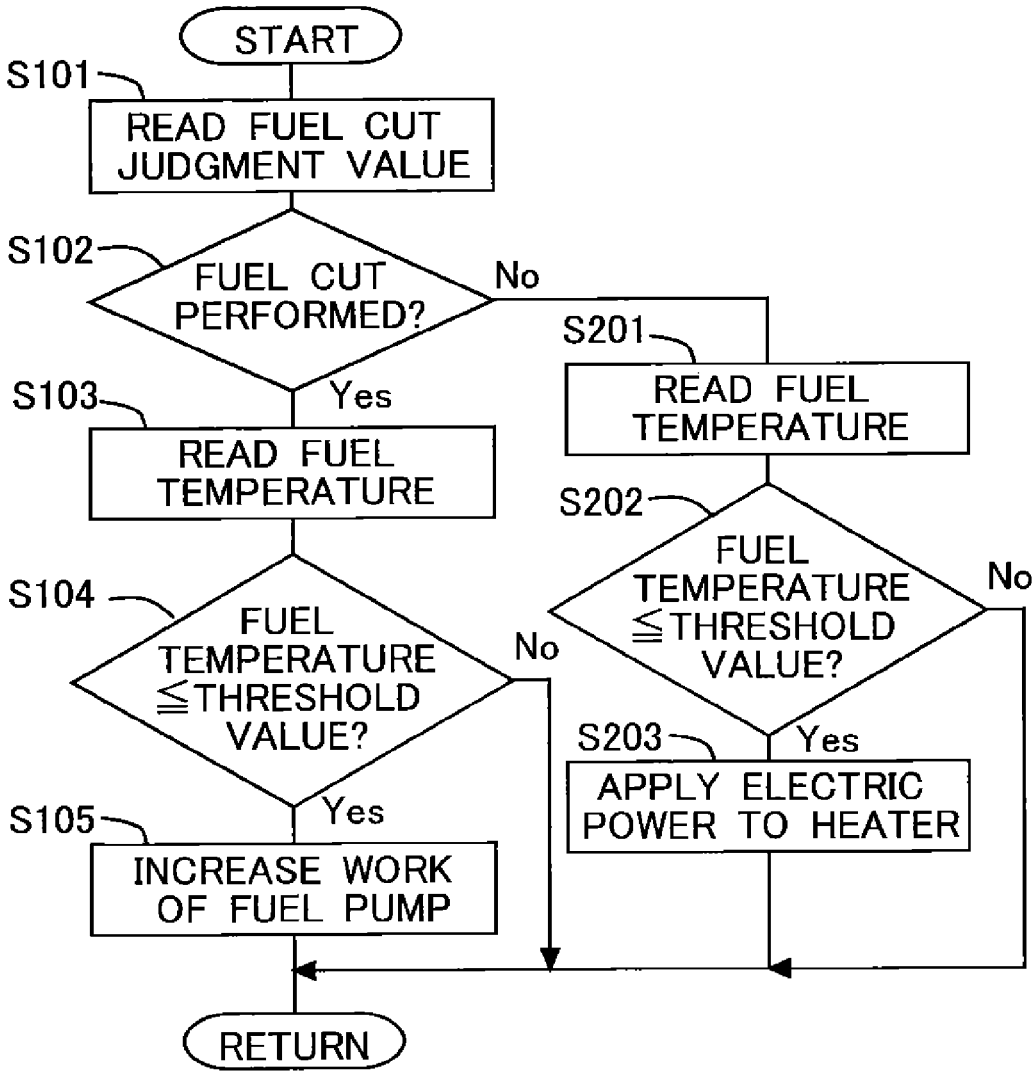
FIG. 10 shows a flow chart of the fuel pressure control according to the fourth embodiment.

FIG. 10 shows a flow chart of the fuel pressure control according to this embodiment. This routine is repeatedly executed by ECU 20 at every predetermined period of time. The steps, in which the same processes as those of the flow shown in FIG. 2 are performed, are designated by the same reference numerals, any explanation of which will be omitted.

If the negative judgment is made in Step S102, i.e., if the fuel injection is performed, then the routine proceeds to Step S201.

In Step S201, the fuel temperature is read. That is, the temperature, which is measured by the temperature sensor 13, is read.

In Step S202, it is judged whether or not the fuel temperature is not more than the threshold value. That is, it is judged whether or not the fuel temperature is required to be raised. If the affirmative judgment is made in Step S202, the routine proceeds to Step S203. If the negative judgment is made, this routine is completed, because it is unnecessary to raise the fuel temperature.

In Step S203, the electric power is applied to the heater 15. That is, the heat is generated by the heater 15 to warm the fuel.

In this way, it is possible to raise the temperature of the fuel without consuming the fuel during the fuel cut. Therefore, it is possible to reduce the electric power consumption of the heater 15, and thus it is possible to improve the mileage or fuel efficiency.

Fifth Embodiment

In this embodiment, the work of the fuel pump 2 is regulated so that the fuel temperature is within a predetermined range. The other components of the apparatus are the same as those of the fourth embodiment, and hence any explanation thereof will be omitted. For example, if the fuel cut period is long in the fourth embodiment, it is feared that the fuel temperature may be excessively raised. In view of the above, in this embodiment, the upper limit value and the lower limit value are set for the fuel temperature, and the work of the fuel pump 2 is regulated so that the work is included in this range. The predetermined range herein refers to the proper range of the fuel temperature. A certain period of time is required until the temperature of the fuel is actually changed even when the work of the fuel pump 2 is increased and/or the heating is performed by the heater. Therefore, it is also allowable that the upper limit value and the lower limit value of the predetermined range are determined while providing margins to a certain extent.

Figure 11:
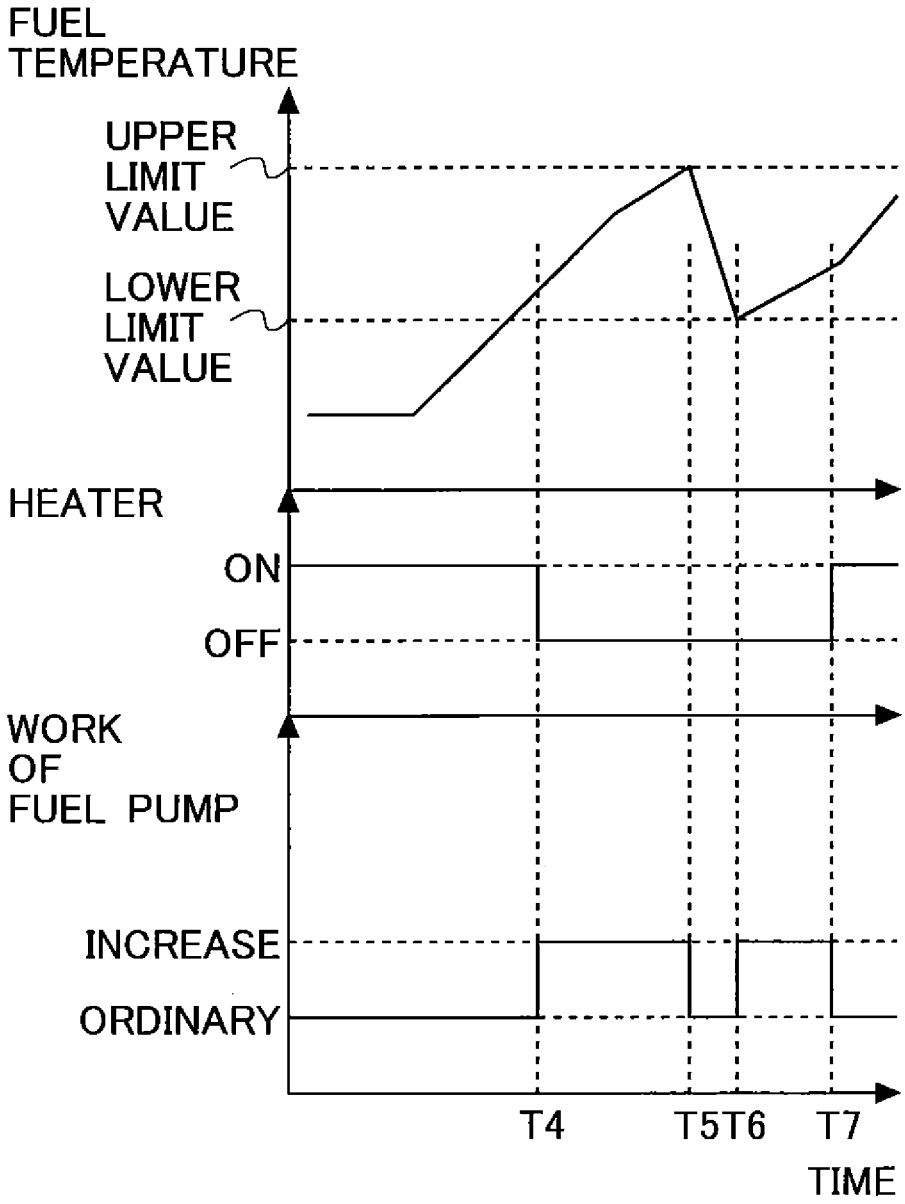
FIG. 11 shows a time chart illustrating the transition or change of the work of a fuel pump, the state of a heater, and the fuel temperature according to a fifth embodiment.

FIG. 11 shows a time chart illustrating the transition or change of the work of the fuel pump, the state of the heater 15, and the fuel temperature according to this embodiment. With reference to FIG. 11, the fuel cut is started at the time indicated by T4. The heater 15 is turned ON before the time indicated by T4, because the fuel temperature does not arrive at the upper limit value. Further, the fuel temperature does not arrive at the upper limit value even at the time indicated by T4, and hence the work of the fuel pump 2 is increased. In other words, the fuel temperature is continuously raised after the time indicated by T4.

The fuel temperature arrives at the upper limit value at the time indicated by T5. Accordingly, the increase in the work of the fuel pump 2 is stopped even when the fuel cut is performed. In accordance therewith, the fuel temperature begins to decrease. In other words, the work of the fuel pump 2 has the same value as that provided in the ordinary situation, and the supply of the electric power to the heater 15 is stopped during the period of time from T5 to T6. Therefore, the fuel temperature is lowered during this period of time. After that, the fuel temperature arrives at the lower limit value at the time indicated by T6. The work of the fuel pump 2 is increased again from the time indicated by T6 as compared with the ordinary situation. Accordingly, the fuel temperature is raised again.

The fuel cut is completed at the time indicated by T7. Accordingly, the work of the fuel pump 2 has the value of the ordinary situation. Further, the supply of the electric power to the heater 15 is started, because the fuel temperature does not arrive at the upper limit value.

As explained above, according to this embodiment, it is possible to allow the fuel temperature to be within the predetermined range. Therefore, it is possible to suppress the excessive increase in the fuel temperature, which would be otherwise caused by the increase in the work of the fuel pump 2.

Sixth Embodiment

Figure 12:
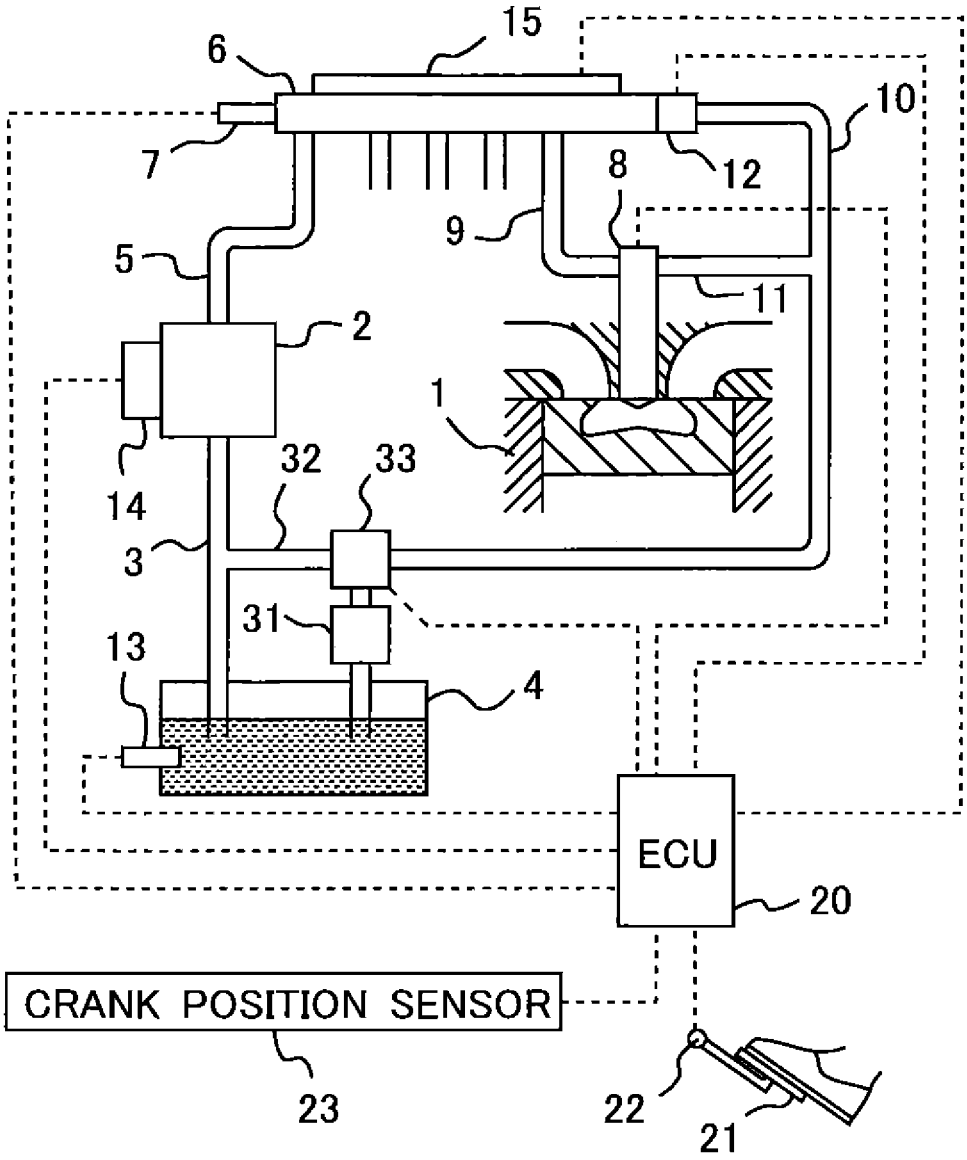
FIG. 12 shows a schematic arrangement illustrating a fuel injection apparatus for an internal combustion engine according to a sixth embodiment.

In this embodiment, the decrease in the fuel temperature is suppressed more efficiently during the fuel cut. FIG. 12 shows a schematic arrangement illustrating a fuel injection apparatus for an internal combustion engine according to this embodiment. In this embodiment, a fuel cooler 31, which lowers the temperature of the fuel by performing the heat exchange between the fuel and the outside air, is attached to an intermediate portion of the return passage 10. Further, a bypass passage 32 is provided, which connects the fuel suction passage 3 and the return passage 10 disposed on the upstream side from the fuel cooler 31. Further, a changeover valve 33, which allows the fuel allowed to flow through the return passage 10 to flow to any one of the side of the bypass passage 32 and the side of the fuel cooler 31, is provided at the portion at which the bypass passage 32 is connected to the return passage 10. The other components of the apparatus are the same as those shown in FIG. 8, and hence any explanation thereof will be omitted.

Even when the work of the fuel pump 2 is increased during the fuel cut, if the fuel passes through the fuel cooler 31 which is the heat exchanger or the fuel tank 4 which has the large heat capacity, then the temperature of the fuel is lowered at such portions. Therefore, a certain period of time is required to raise the fuel temperature. On the contrary, in this embodiment, the fuel is allowed to flow from the return passage 10 to the side of the bypass passage 32 when the fuel temperature is not more than the threshold value. The fuel, which is allowed to flow from the return passage 10 to the fuel suction passage 3, is sucked as it is by the fuel pump 2. Therefore, the temperature is not lowered at the fuel cooler 31 and the fuel tank 4. In this way, it is possible to suppress the decrease in the temperature. Therefore, it is possible to quickly raise the fuel temperature in the region ranging from the fuel pump 2 to the common rail 6.

Figure 13:
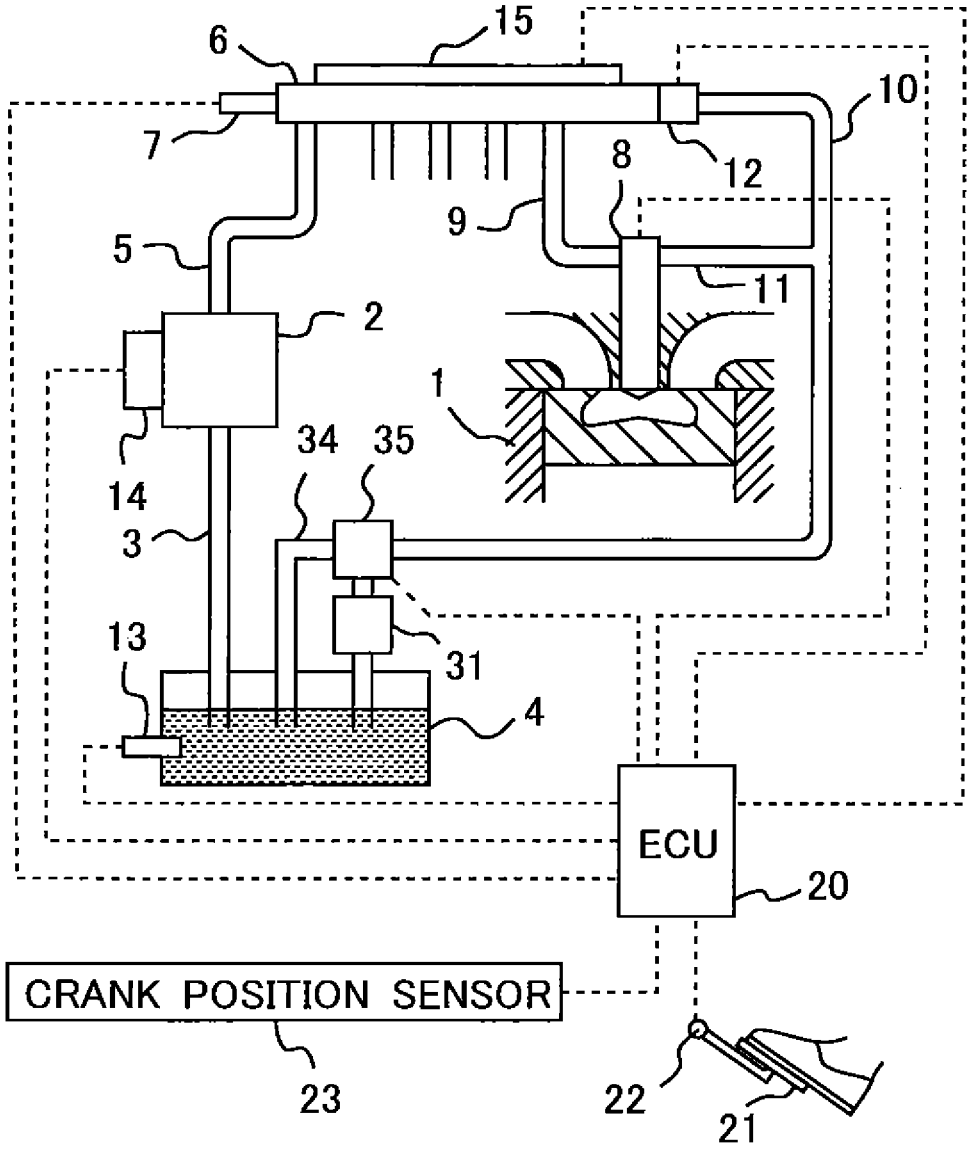
FIG. 13 shows another schematic arrangement illustrating a fuel injection apparatus for an internal combustion engine according to the sixth embodiment.

FIG. 13 shows another schematic arrangement illustrating a fuel injection apparatus for an internal combustion engine according to this embodiment. With reference to FIG. 13, a bypass passage 34 is provided, which connects the fuel tank 4 and the return passage 10 disposed on the upstream side from the fuel cooler 31. A changeover valve 35, which allows the fuel to flow to any one of the side of the bypass passage 34 and the side of the fuel cooler 31, is provided at the portion at which the bypass passage 34 is connected to the return passage 10. The other components of the apparatus are the same as those shown in FIG. 8, and hence any explanation thereof will be omitted.

Owing to the arrangement as described above, the fuel makes a detour to avoid the fuel cooler 31 when the fuel temperature is not more than the threshold value. Therefore, the fuel temperature is not lowered by the fuel cooler 31. Therefore, it is possible to quickly raise the fuel temperature. Further, it is also possible to warm the fuel contained in the fuel tank 4.

REFERENCE SIGNS LIST

1: internal combustion engine, 2: fuel pump, 3: fuel suction passage, 4: fuel tank, 5: fuel supply passage, 6: common rail, 7: pressure sensor, 8: injection valve, 9: branch pipe, 10: return passage, 11: discharge passage, 12: relief valve, 13: temperature sensor, 14: actuator, 15: heater, 20: ECU, 21: accelerator pedal, 22: accelerator opening degree sensor, 23: crank position sensor, 31: fuel cooler, 32: bypass passage, 33: changeover valve, 34: bypass passage, 35: changeover valve.

The invention claimed is:

1. A fuel injection apparatus for an internal combustion engine, comprising:

an electronic control unit which judges whether or not a fuel cut state, in which supply of fuel to the internal combustion engine is temporarily stopped during deceleration of a vehicle, is given; and a pump which discharges the fuel by means of a motive power applied from a rotary shaft of the internal combustion engine, wherein:

the electronic control unit increases work of the pump when it is judged that the fuel cut state is given as compared with when it is not judged that the fuel cut state is given.

2. The fuel injection apparatus for the internal combustion engine according to claim 1, further comprising a relief valve which changes a pressure of the fuel, wherein the electronic control unit increases the work of the pump by increasing the pressure of the fuel by means of the relief valve.

3. The fuel injection apparatus for the internal combustion engine according to claim 1, further comprising an actuator which changes a discharge amount of the fuel from the pump, wherein the electronic control unit increases the work of the pump by increasing the discharge amount of the fuel by means of the actuator.

4. The fuel injection apparatus for the internal combustion engine according to claim 1, further comprising a relief valve which changes a pressure of the fuel and an actuator which changes a discharge amount of the fuel from the pump, wherein the electronic control unit increases the work of the pump as a whole by increasing any one of the pressure and the discharge amount of the fuel and decreasing the other.

5. The fuel injection apparatus for the internal combustion engine according to claim 1, further comprising:

a sensor which detects a temperature of the fuel of the internal combustion engine; and a heater which heats the fuel by generating heat, wherein:

the work of the pump is increased by the electronic control unit if the temperature, which is detected by the sensor, is not more than a threshold value and it is judged that the fuel cut state is given; and the fuel is heated by the heater if the temperature, which is detected by the sensor, is not more than the threshold value and it is judged that the fuel cut state is not given.

6. The fuel injection apparatus for the internal combustion engine according to claim 5, wherein:

the increase in the work of the pump by the electronic control unit or the heating of the fuel by the heater is started if the temperature, which is detected by the sensor, is lower than a predetermined lower limit value; and the increase in the work of the pump by the electronic control unit and the heating of the fuel by the heater are stopped if the temperature, which is detected by the sensor, is higher than a predetermined upper limit value.

* * * * *